United States Patent [19]

Merz

[11] 4,437,819

[45] Mar. 20, 1984

[54] CONTROLLABLE VANE PUMP

[75] Inventor: Johann Merz, Bopfingen, Fed. Rep. of Germany

[73] Assignee: Zahnradfabrik Friedrichshafen, AG, Friedrichshafen, Fed. Rep. of Germany

[21] Appl. No.: 379,935

[22] Filed: May 19, 1982

[30] Foreign Application Priority Data

Jun. 6, 1981 [DE] Fed. Rep. of Germany ..... 3122598

[51] Int. Cl.[3] ..... F04C 2/00; F04C 15/04

[52] U.S. Cl. ..... 418/26; 418/27; 418/30

[58] Field of Search ..... 418/30, 24, 25, 26, 418/27

[56] References Cited

U.S. PATENT DOCUMENTS

| | | | |
|---|---|---|---|
| 2,433,484 | 12/1947 | Roth | 418/30 |
| 2,658,456 | 11/1953 | Wahlmark | 418/26 |
| 3,642,388 | 2/1972 | Maistrelli | 418/30 |

FOREIGN PATENT DOCUMENTS 2026094 1/1980 United Kingdom .

OTHER PUBLICATIONS

Erkki Koivunen and Philip Le Bar, "A New Automatic Transmission for Improved Fuel Economy General Motors THM125" *SAE* Technical Paper Series (Jun. 11-15, 1979).

*Primary Examiner*—John J. Vrablik
*Assistant Examiner*—John J. McGlew, Jr.
*Attorney, Agent, or Firm*—Zalkind & Shuster

[57] ABSTRACT

A control ring in sliding contact with the radially outer ends of fluid displacing vanes on a pump rotor, is angularly adjustable about a pivot formation in a pump housing on one radial side of the rotor opposite a limited sealing surface on the housing having a center of curvature on the rotor axis. A sealing element pivotally mounted on the control ring is biased into wiping contact with the sealing surface to divide the pump housing into inlet and outlet pressure chambers.

6 Claims, 5 Drawing Figures

FIG. 1
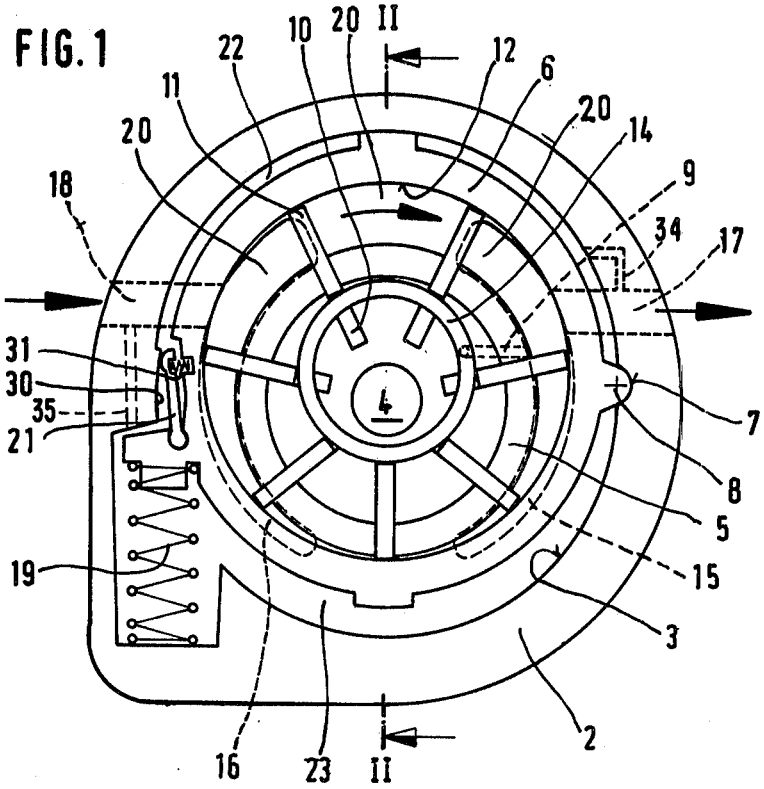
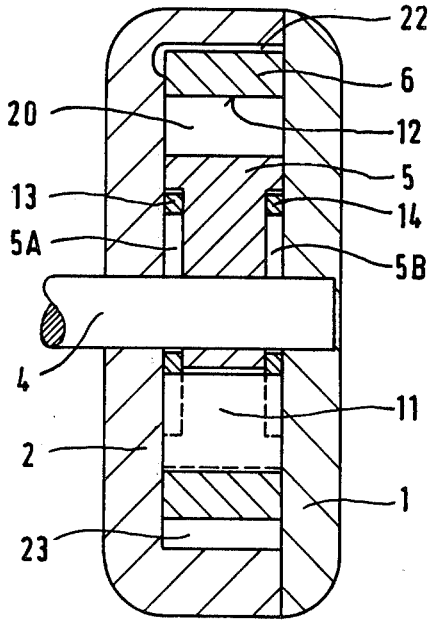
FIG. 2

CONTROLLABLE VANE PUMP

BACKGROUND OF THE INVENTION

This invention relates to a radial vane type of pump assembly having flow rate varying facilities associated therewith.

Adjustable radial vane pumps having an angularly adjustable annular control ring in the pump housing, is already well known as described for example in SAE Publication No. 790725 of June 1979. Page 7 and FIG. 10 in said publication describes such a pump wherein the annular control ring is supported in the pump housing for pivotal displacement by means of a pivot pin fixed to the housing. On a radial side opposite the pivot pin, the housing is provided with a seal mounted on the annular control ring. Two pressure chambers are thereby formed in the housing, one of which is connected to the pump outlet while the other is connected to the pump inlet. The outlet connected pressure chamber is provided with a spring urging displacement of the annular control ring against the bias of the outlet pressure. The differential outlet pressure that is developed effects displacement of the annular ring member in one direction to reduce the radial stroke of the pump vanes between which fluid displacing chambers are formed to thus regulate the pump flow rate. The housing of the foregoing pump assembly has a so-called "sandwich" type of configuration formed by an intermediate annular housing section and the end covers. In order to obtain satisfactory sealing in all adjusted position of the annular control ring, associated arcuate sealing surfaces in the housing are formed with reference to the pivot point about which the annular control ring is angularly displaced. The manufacture of the housing assembly pursuant to the foregoing prior art arrangement is extremely costly.

It is therefore an important object of the present invention to provide a less costly radial vane type pump having an angularly adjustable flow rate, regulating annular control ring with an acceptable sealing arrangement for a relatively large and variable radial sealing gap.

SUMMARY OF THE INVENTION

In accordance with the present invention, a radial vane type pump with a flow rate adjusting control ring is provided with a pump housing formed with a limited arcuate sealing surface having a center of curvature at the axis of the rotor shaft with a sealing device engaged with such sealing surface to provide a suitable seal for the relatively large radial gap involved in accommodating angular adjustment of the control ring. The sealing device is in the form of a lever element pivotally mounted on the control ring with its free end biased by spring and fluid pressures into contact with the radial sealing surface between different pump pressure chambers. A simple and functionally reliable arrangement is thereby realized that is also less costly than comparable prior art arrangements.

BRIEF DESCRIPTION OF DRAWING FIGURES

The invention is described hereinafter in more detail with respect to specific embodiments as shown in the accompanying drawings, wherein:

FIG. 1 is a top plan view of a vane cell pump in accordance with one embodiment of the invention, with the pump housing cover removed;

FIG. 2 is a side section view of the pump shown in FIG. 1, with the pump housing cover applied, taken substantially through a plane indicated by section line II—II in FIG. 1;

Figure 5:
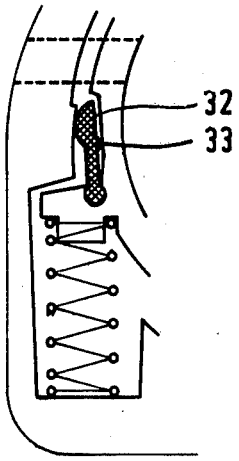

and FIG. 5 is a partial top plan view of a vane cell pump showing another embodiment of the sealing device associated therewith.

DETAILED DESCRIPTION OF PREFERRED EMBODIMENTS

Referring now to the drawings in detail, FIGS. 1 and 2 illustrate a vane cell pump in accordance with one embodiment of the invention having a pot-shaped housing 2 closed by a cover 1 to form a housing assembly held together by a plurality of screw fasteners (not shown). The housing assembly encloses a space 3 within which a rotor 5 is mounted for rotation about a fixed rotor axis extending through a rotor shaft 4 journaled at spaced locations between housing 2 and cover 1. An annular control ring 6 is also disposed internally within the enclosure space 3 and is supported therein by a pivot formation 7 of the housing 2 as shown in FIG. 1. The annular control ring 6 is pivotally adjustable in a plane perpendicular to the rotor axis through shaft 4 about a pivot axis at 8 in FIG. 1.

The rotor 5 is provided with a plurality of radial slots within which pump vanes 11 are slidably mounted. The radially outer ends of the vanes 11 are in sliding contact with an internal peripheral surface 12 of the control ring 6. As shown in FIG. 2, the rotor 5 is also provided on both axial sides thereof with recesses 5A and 5B intersecting the slots within which the vanes 11 are slidably mounted. Pressure sealing ring 13 and 14 are seated within the recesses 5A and 5B and are thereby held in contact with the vanes 11 in wiping engagement with the internal peripheral surface 12 of the ring 6. Within the axial end portion of the housing member 2, opposite the cover 1, a pair of kidney-shaped recesses 15 and 16 are formed as shown by dotted line in FIG. 1. The recess 15 is disposed on that side of the rotor shaft 4 at which the pivot axis at 8 is located and is in communication with an outlet passage 17 also formed in the housing member 2 as shown by dotted line. The recesses 5A and 5B are in fluid communication with recess 15 through a passage 9 as shown in dotted line so that the radially inner end surfaces of the vanes are subjected to the fluid outlet pressure in the outlet passage 17. On that side of the rotor shaft 4 opposite the pivot axis at 8, the recess 16 is disposed in fluid communication with an inlet passage 18, as shown in dotted line in FIG. 1, to which fluid is conducted from a reservoir tank. Pressurized fluid is conducted to fluid displacing chambers 20 formed between the vanes 11 radially between the rotor 5 and ring 6. These chambers 20 extend angularly in a clock-wise direction from the inlet passage 18 to the outlet passage 17 as shown in FIG. 1. A return spring 19 disposed within a cavity formed in the housing member 2 and extending tangentially from enclosure space 3, exerts a bias on the annular ring 6 in a clock-wise direction as viewed in FIG. 1 against the housing. As a result thereof, an annular space of varying radial extent is developed between the rotor 5 and ring 6 of maximum volume or size in the limit position to which the ring 6 is urged by spring 9.

With continued reference to FIG. 1, a sealing device 21 is provided in accordance with the present invention on that side of the annular ring 6 opposite its pivot axis at 8. By virtue of such sealing device and its location relative to the pivot formation 7 in the housing, the pump enclosure space 3 is divided into two pressure chambers 22 and 23. One of the pressure chambers 22 is in continuous fluid communication with outlet passage 17 through a connecting passage 34 as shown by dotted line while the other pressure chamber 23 is in continuous fluid communication with inlet passage 18 through any suitable connecting passage 35. As a result of the foregoing arrangement, a pressure differential between pressure chambers 22 and 23 is developed in response to an increase in pressure applied to a fluid operated device by the pump assembly through the outlet passage 17, causing the annular ring 6 to be angularly displaced about its pivot axis against the bias of the return spring 19. As a result of such angular displacement of the control ring 6, the fluid displacing chambers 20 formed between the pump vanes 11 are reduced in volume to thereby provide pump flow rate regulation under pressure control independent of pump speed.

Figure 3:
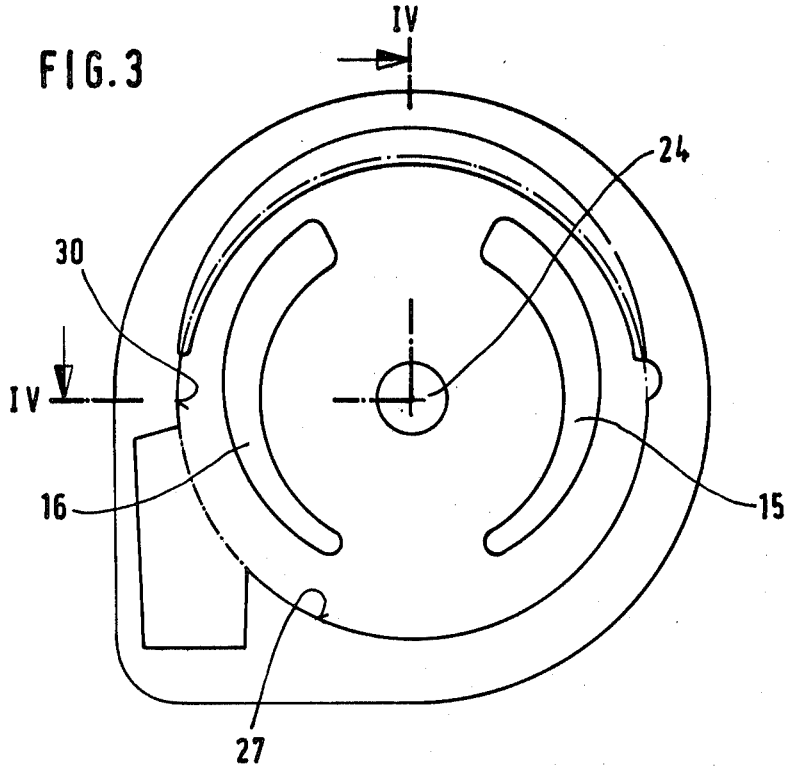
FIG. 3 is a top plan view of the housing similar to FIG. 1, but with separate housing supported parts of the pump removed.
Figure 4:
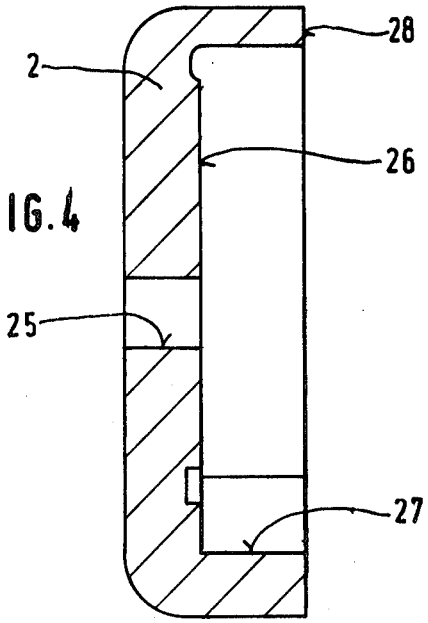
FIG. 4 is a section view taken substantially through a plane indicated by section line IV—IV in FIG. 3.

With reference to FIGS. 3 and 4, the internal configuration of the pump housing 2 will become apparent. A central bearing bore 25 is formed therein for the rotor shaft 4 and extends from an interior planar control surface 26. An interrupted cylindrical surface 27 extends axially from surface 26 and is terminated at an axial end flange surface 28 which abuts housing cover 1. The cylindrical surface 27 has a sealing portion 30 for the sealing device 21 aforementioned. In view of the angular adjustment of the ring 6 about the pivot axis at 8, a radially variable sealing gap is established at the radial sealing portion 30. This sealing gap is balanced by sealing device 21 because of its pivotal mounting on the control ring 6 as shown in FIG. 1. The sealing device is in the form of a lever element biased into contact with the sealing portion 30 by a spring member 31 and the pressurized fluid in pressure chamber 22. Other forms of springs may replace the spring member 31, such as a cylindrical rubber body.

According to the embodiment illustrated in FIG. 5, a sealing strip element 32 made of a plastic material replaces the sealing lever element 21 hereinbefore described. The sealing element 32 is formed with a contact projection 33 acting as a spring so as to eliminate the need of a separate spring member 31 as hereinbefore described.

It will be apparent from the foregoing description, that the configuration and construction of the internal surfaces of housing member 2 have a convenient reference point at center 24 on the rotor axis through shaft 4. The pump assembly operates with the control ring 6 pivotally supported exclusively by the housing and angularly adjusted for regulating the flow rate of fluid as a function of the differential pressure in pressure chamber 22 opposed by the bias of return spring 19. The sealing portion 30 on the cylindrical surface 27, has a center of curvature 24 at the rotor shaft axis to form a sealing gap that varies radially in response to pivotal displacement of the ring 6. Such sealing gap is taken up by the pivotal sealing element 21 or 32 as hereinbefore described. Pressure chamber 22 connected to outlet passage 17 is therefore sealed against the differential pressure in inlet pressure chamber 23 by virtue of the sealing element pivotally mounted on the control ring 6 and movable therewith when angularly adjusted.

What is claimed is:

1. In an adjustable vane cell pump having a rotor, a plurality of radially displaceable vanes slidably mounted on the rotor, a control ring in sliding contact with the vanes enclosing fluid displacing spaces therebetween, means biasing the vanes into said sliding contact with the control ring, a housing formed with an internal surface and means pivotally supporting the control ring in the housing exclusively at a pivot point for angular adjustment to vary flow rate, the improvement residing in sealing means including an arcuate sealing portion (30) of the internal surface concentric with the rotor (5) mounted radially opposite the pivot point, a sealing element (21, 32) having opposite ends, and means pivotally mounting one of said ends of the sealing element on the control ring (6), the other of the ends of the sealing element being held in contact with the sealing portion on the housing (2).

2. In an adjustable vane cell pump having a rotor, a plurality of radially displaceable vanes slidably mounted on the rotor, a control ring in sliding contact with the vanes enclosing fluid displacing spaces therebetween, means biasing the vanes into said sliding contact with the control ring, and housing means pivotally supporting the control ring exclusively at a pivot point for angular adjustment to vary flow rate, the improvement residing in a sealing device mounted between the control ring and the housing means radially opposite the pivot point, including a sealing element (21, 32) having opposite ends, means pivotally mounting one of said ends of the sealing element on the control ring (6), the other of the ends of the sealing element being held in contact with the housing means (2), and a spring element (31, 33) disposed between the control ring and the sealing element.

3. The improvement as defined in claim 2 wherein said spring element is a rubber body.

4. The improvement as defined in claim 1 wherein the sealing element (32) is a plastic member having a biasing projection (33).

5. In an adjustable vane pump having a rotor (5) rotatable about a rotor axis, a plurality of radially displaceable vanes (11) projecting therefrom, a control ring (6) slidably engaged by the vanes, a housing (2) enclosing the rotor, the vanes and the control ring, means pivotally mounting the control ring exclusively on the housing for pivotal displacement about a pivot axis radially spaced from the rotor, and a sealing device dividing the housing into inlet and outlet pressure chambers, said housing having, a substantially cylindrical surface (27) forming a pump enclosure for the pressure chambers in substantially concentric relation to the rotor axis, the improvement residing in a limited sealing portion (30) on said cylindrical surface to which engagement of the sealing device is confined, the sealing device including a lever element pivotally mounted on the control ring radially opposite the pivot axis, and means biasing the lever element into wiping contact with said sealing portion within a sealing gap formed between the control ring and the cylindrical surface of the housing.

6. The improvement as defined in claim 5 wherein said biasing means includes means for exerting fluid pressure in the outlet pressure chamber (22) on the lever element (21, 32).

* * * * *